United States Patent [19]

Croizer

[11] Patent Number: 4,488,487

[45] Date of Patent: Dec. 18, 1984

[54] STEPPED BODY PENETRATION BOMB

[75] Inventor: Pierre C. Croizer, Elancourt, France

[73] Assignee: MATRA, Paris, France

[21] Appl. No.: 455,841

[22] Filed: Jan. 5, 1983

[30] Foreign Application Priority Data

Jan. 8, 1982 [FR] France ..... 82 00253

[51] Int. Cl.[3] ..... F42B 25/20; F42B 25/08

[52] U.S. Cl. ..... 102/382; 102/398; 102/473

[58] Field of Search ..... 102/382, 384, 394, 398, 102/473, 476

[56] References Cited

U.S. PATENT DOCUMENTS

| | | | |
|---|---|---|---|
| 3,002,453 | 10/1961 | Fedor et al. | 102/382 |
| 3,677,179 | 7/1972 | Potteiger et al. | 102/473 |
| 3,941,057 | 3/1976 | Peterson et al. | 102/364 |
| 4,090,446 | 5/1978 | Tomasetti | 102/394 |

FOREIGN PATENT DOCUMENTS

| | | | |
|---|---|---|---|
| 62962 | 7/1892 | Fed. Rep. of Germany . | |
| 3010917 | 10/1981 | Fed. Rep. of Germany | 102/476 |
| 1292383 | 3/1962 | France . | |
| 2310547 | 12/1976 | France | 102/476 |

*Primary Examiner*—Charles T. Jordan

*Attorney, Agent, or Firm*—Larson and Taylor

[57] ABSTRACT

A penetration bomb has a resistant body containing an explosive composition. The body has a rear portion connected by an intermediate portion to a front portion of reduced diameter. While the rear portion has a high explosive content, typically higher than 75%, the front portion has a thick content of explosive charge, typically about 15%. The intermediate zone is approximately frustoconical for transferring kinetic energy from the rear portion to the front portion which acts as a penetrator before firing of its explosive content.

12 Claims, 12 Drawing Figures

STEPPED BODY PENETRATION BOMB

BACKGROUND AND SUMMARY OF THE INVENTION

The present invention relates to a penetration bomb, i.e. a bomb for use against an objective having a thick resistant wall. The term "bomb" should be construed as designating any heavy projectile which is subsonic on impact and includes glide bombs, with possibly a propulsion motor, and accelerated bombs, as well as free fall bombs, guided or not.

The invention is particularly, although not exclusively, suitable for use in the field of guided bombs for attacking precisely defined targets having considerable vertical development and accelerated bombs for attacking targets having large horizontal development, such as runways and the shielded decks of ships.

For some purposes, it is required for the bomb to completely ruin the wall and demolish it. In others, it is sufficient for it to form a crater of appreciable size and, at the same time, shake and crack the target. Penetration bombs are already known for attaining these results. They typically have a shape close to that of large-sized shells for destroying armoured targets, that is having a front ogive and a cylindrical body, with a very resistant shell and relatively small explosive content. The penetration effect is due essentially to the kinetic energy and the bombs present, with respect to shells, the drawbacks of a substantially lower speeed.

The penetration of a resistant projectile into a target is all the greater the smaller its diameter. This fact has been used more particularly in sub-caliber shells, or "arrow" shells but that approach can hardly be transposed to bombs whose speeds are much lower and whose kinetic energy is generally insufficient. It has also been suggested to fit a solid extension of small diameter forming a chisel to the front of the shell (German Pat. No. 2,036,897). Such approaches, when used on bombs, are of no substantial advantage.

It is an object of the invention to provide a penetration bomb having greatly increased efficiency for a same weight. A penetration bomb according to the invention has a body and an explosive charge. The body has a front thick-walled part and a rear part with a diameter greater than that of the front wall and a high explosive content. The front part also contains explosive but has a charge or filling coefficient (ratio of the content of explosive to total weight) very much less than that of the rear part. It is connected to the rear part by an intermediate body zone capable of transmitting to the front part the kinetic energy of the rear part at the impact.

This construction is based on a totally different approach from those previously adopted. A first crater is formed in the objective over a considerable depth by the front part due to (i) the small diameter of the front part, to which the intermediate part transmits kinetic energy. That momentum is very much greater than it would be if the rear part had the same diameter as the front part, since the mass is very much increased and (ii) the explosive charge is contained in the front part. There is mechanical damage to the wall by the front part, which forms a dart or chisel, over an area whose diameter is of about 1.4 time the diameter of the front part. When firing takes place, with a delay which will be selected depending on the characteristics of the bomb, the rear part thereof will have engaged in the area damaged by the front part so that its explosion will have maximum effect.

The front part will typically have a diameter between 0.2 and 0.8, generally 0.4 to 0.6, that of the rear part. A ratio of 0.5 will generally be close to optimum. The length of the front part and of the connecting zone will be chosen depending on the thickness of the wall of the target, at least when it is required to open a traversing breach in the wall. In practice, a length a half of the thickness to be traversed will generally be satisfactory. The filling coefficient will have a value very different in the front and rear parts, typically about 0.15 for the front part and more than 0.75 for the rear part.

The intermediate part may be designed to transmit the driving-in forces of the front part, while presenting a certain flexibility for dampening the shock of the impact: in general, an approximately conical shape having an angle at the apex between 40° and 120° gives satisfactory results.

The invention will be better understood from the following description of particular embodiments of the invention, given by way of examples.

SHORT DESCRIPTION OF THE DRAWINGS

Figure 1:
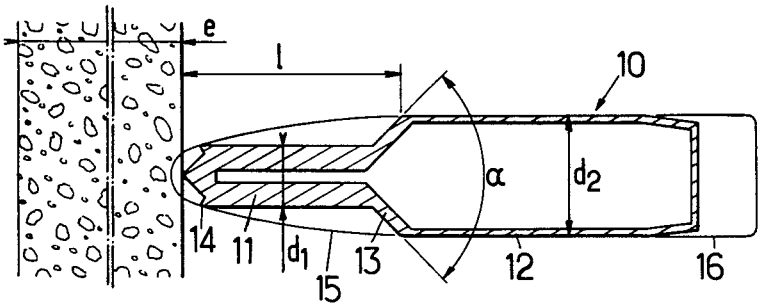
FIG. 1 shows schematically the construction of a bomb according to a first embodiment, in cross-section through a plane passing through the longitudinal axis of the bomb.
Figure 2A:
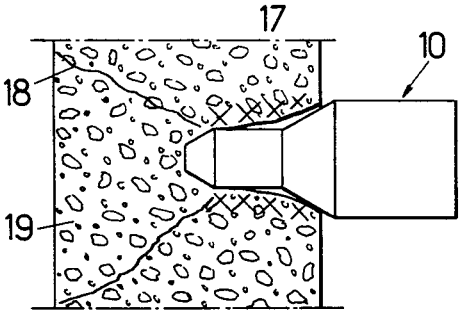
FIGS. 2A and 2B are diagrams showing the destruction of the wall of a target by a bomb of the kind shown in FIG. 1.
Figure 4:
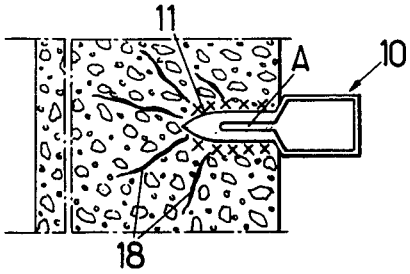
Figure 5:
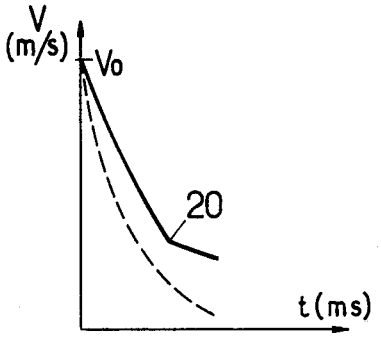

FIG. 4, similar to FIG. 2A, shows the penetration of a bomb in accordance with the invention into a wall of practically infinite thickness;

FIG. 5 illustrates the variation of the speed with time from impact in the case of a conventional bomb and a bomb according to FIGS. 1 and 2; and FIGS. 6–10 are simplified views of modified embodiments.

DETAILED DESCRIPTION OF PARTICULAR EMBODIMENTS

Referring to FIG. 1, a bomb 10, designed for ruining, rather than damaging, pinpoint targets having a vertical development, such as bridge piers, has a body containing an explosive charge. The body is formed of a front part 11 with a thicker wall and a rear part 12 with a thinner wall, connected together by an intermediate zone 13. The explosive charge of the front part will be relatively small, this part having to have high structural resistance so as to act as a punch at the time of impact. The filling coefficient c/m (ratio of the mass of explosive to the total mass) will be between 0.1 and 0.3 and typically of about 0.15.

In the case where the bomb is designed to arrive on the objective at a moderate speed, for example 150 m/s; which is the case for a glide bomb, and with an incidence which will not be normal, but rather of the order of 60°, the nose of the front part must be designed to limit the risk of ricochets. A nose may more especially be used having a central part in the shape of a point or an ogive with a sharp edge 14. To improve the aerodynamic qualities of the bomb, the body may be provided with a fairing 15 of a light material. The length l of the front part is chosen depending on the thickness e of the wall of the objective: in practice, a value of about half of e will be given to l so as to draw the maximum advantage from the destruction process which will be described hereafter.

The rear part, whose diameter $d_2$ will generally be of the order of twice the diameter $d_1$ of the front part, has a c/m ratio much higher than the front part, which will generally exceed 0.75 and will be frequently between 0.8 and 1. As will be seen further on, this rear part is subjected to moderate stresses because of the damping effect of the shock of impact by the intermediate part. Consequently, the rear part may have a thin wall without for all that being ruptured at the time of impact of the nose of the bomb.

The intermediate zone 13 fulfils a double role. It must be sufficiently stiff to transmit the forces and sufficiently flexible to soften the shocks and impact vibrations. This result is reached by giving to the intermediate zone a shape opening out rearwardly, generally approximately conical, which may have a decreasing thickness from the front to the rear, with an angle at the apex between 60° and 120°. However, other evolutive forms are possible, particularly with a curved generatrix having a bending point and joining up with the straight line generatrix of the front and rear parts.

The bomb may be completed by a firing device, which will generally be fitted from the rear. This device will generally comprise a delay fuse, causing firing after a time delay which will depend on the nature of the objective. In some cases, firing may be used by detecting the deceleration peak on impact and causing ignition when the deceleration has ceased.

Furthermore, the bomb may comprise subsidiary elements, for example a rear compartment 16 containing electronic means a rocket motor etc.. and a front guide part. This device may more especially be formed by a passive infrared guidance system steering the bomb on to the objective designated by a laser illuminator.

The process of destruction caused by a bomb of the kind which has just been described may be explained in the following way, whose accuracy should not however be considered as a condition of the validity of the patent.

When the bomb reaches impact, as shown in FIG. 1, the front part 11 causes the wall to split and penetrates into this wall over a depth which corresponds substantially to its length. As shown in FIG. 2A, not only is a hole formed having an entrance cone, but the building is also damaged in an annular zone whose diameter is of the order of $1.4d_1$. In the damaged region, if it is a question of concrete, this latter loses all cohesion so as to form only a disintegrated mass which only resists movement by its mass. There is at the same time cracking of the wall. When this wall is made from concrete, it will crack approximately following the generatrices of a cone 18 and remove practically a block of concrete 19 as soon as the penetration is of the order of e/2.

The low value of $d_1$ results in several advantages: on the one hand, the shearing surface along which cracks 18 is much smaller than it would be for a bomb of constant diameter having the same mass; block 19 is of smaller mass; and the kinetic energy of the rear part 12 is transmitted to the front part, where it is exerted on a surface of action much more limited than if the bomb were of constant diameter.

Figure 3:
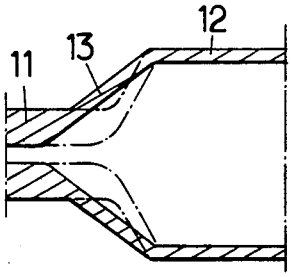
FIG. 3 shows schematically with a dash-dot line, the type of deformation which occurs in the intermediate zone of the bomb on impact.

The transmission of kinetic energy takes place through the intermediate zone 13, which is deformed as shown schematically, in a very exaggerated way, in FIG. 3.

Figure 2B:
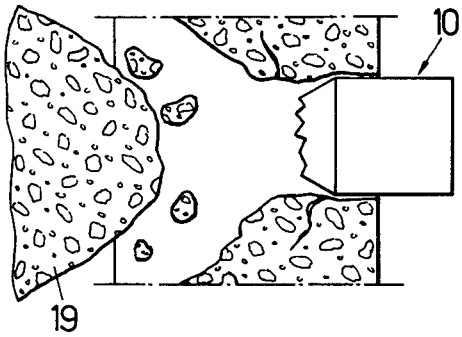

The explosive contained in the front part 11 drives out the plug 19, opens a breach on each side of the wall and cracks this latter (FIG. 2B). The explosion of the rear part engaged in the hole (caused for example by the shock wave of the explosion of the front) causes, through blast effect, breaking up and destruction of the wall over a large volume and ruins it by driving out the split off blocks.

When the bomb is intended to cause damage by exploding in the zone situated beyond the wall, its characteristics will be chosen so that the complete driving of the front part into the wall only consumes a fraction, typically of the order of a third, of the kinetic energy. This driving-in further damages the wall over a diameter substantially greater than the diameter of the front part. In the case of a wall made from reinforced concrete, this latter loses all cohesion in a volume whose diameter is about 1.4 times that of the front part. Moreover, there is splintering of the outlet face of the wall and, as soon as the front part has been driven in for about half the thickness, cracking of the concrete as far as the outlet face. Splintering is further promoted if the nose of the bomb is given a flat form which creates in the concrete an intense compression stress which is reflected in the form of a wave causing tensile stresses.

The bomb then continues its penetration, the rear part driving out the broken up concrete and the fragments of the cracked part. The firing delay is then selected so that the explosion of the rear part occurs beyond the wall.

Finally, in the case where the bomb is intended for attacking a wall of a thickness such that it can only be shaken or damaged, the front part will generally be given the shape of an elongate ogive so that it is forced into the wall and remains there anchored after absorption of all the kinetic energy. The destruction process is then as follows. After penetrating into the wall, and causing the zone which surrounds it to become fragile (FIG. 4), the front part is fired (igniter placed at point A, for example). This explosion causes cracking of the material of the wall at 18 and a first tearing away of fragments. The subsequent explosion of the rear part creates a pressure wave towards the inlet face and a blast effect which disperses the fragments of the objective remaining in place and shakes the wall in depth.

Comparative tests carried out with bombs of the same mass, one in accordance with the invention and the other having a cylindrical shape with ogival nose, with the same impact speed $V_O$, have demonstrated that the penetration of the bomb of the invention was much greater, which can moreover be perfectly understood with reference to FIG. 5, which shows the variation in time of the speed from the moment of impact. The reduction in speed is much faster in the case of the conventional shape (broken line) than in the case of the invention (continuous line). The bend 20 in the case of the invention corresponds to breaking up of the concrete wall.

The invention is susceptible of numerous variations some of which will now be described.

Figure 6:
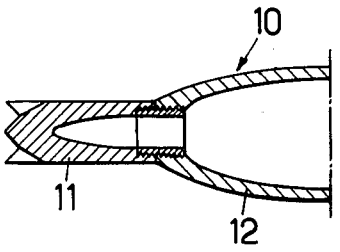

Referring to FIG. 6, the bomb 10 is formed from two assembled parts, the rear part 12 and the intermediate zone being formed by the body of a conventional bomb, whereas the front part 11 is formed by a perforation element added, in the place of the usual ignition fuse.

Figure 7:
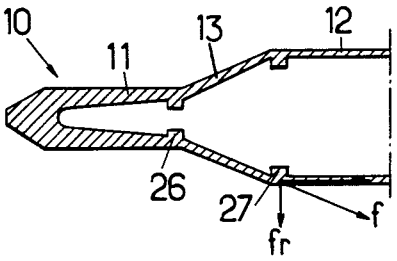
Figure 9:
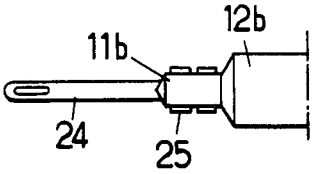

In the case shown in FIG. 7, the shell of bomb 10 has two internal belts 26 and 27 at the junction of the intermediate zone with the front and rear parts 11 and 12. These belts absorb more particularly the radial component ($f_r$) of the forces (f) and allow the intermediate zone to work under traction-compression rather than under flexion.

Figures 8A, 8B:
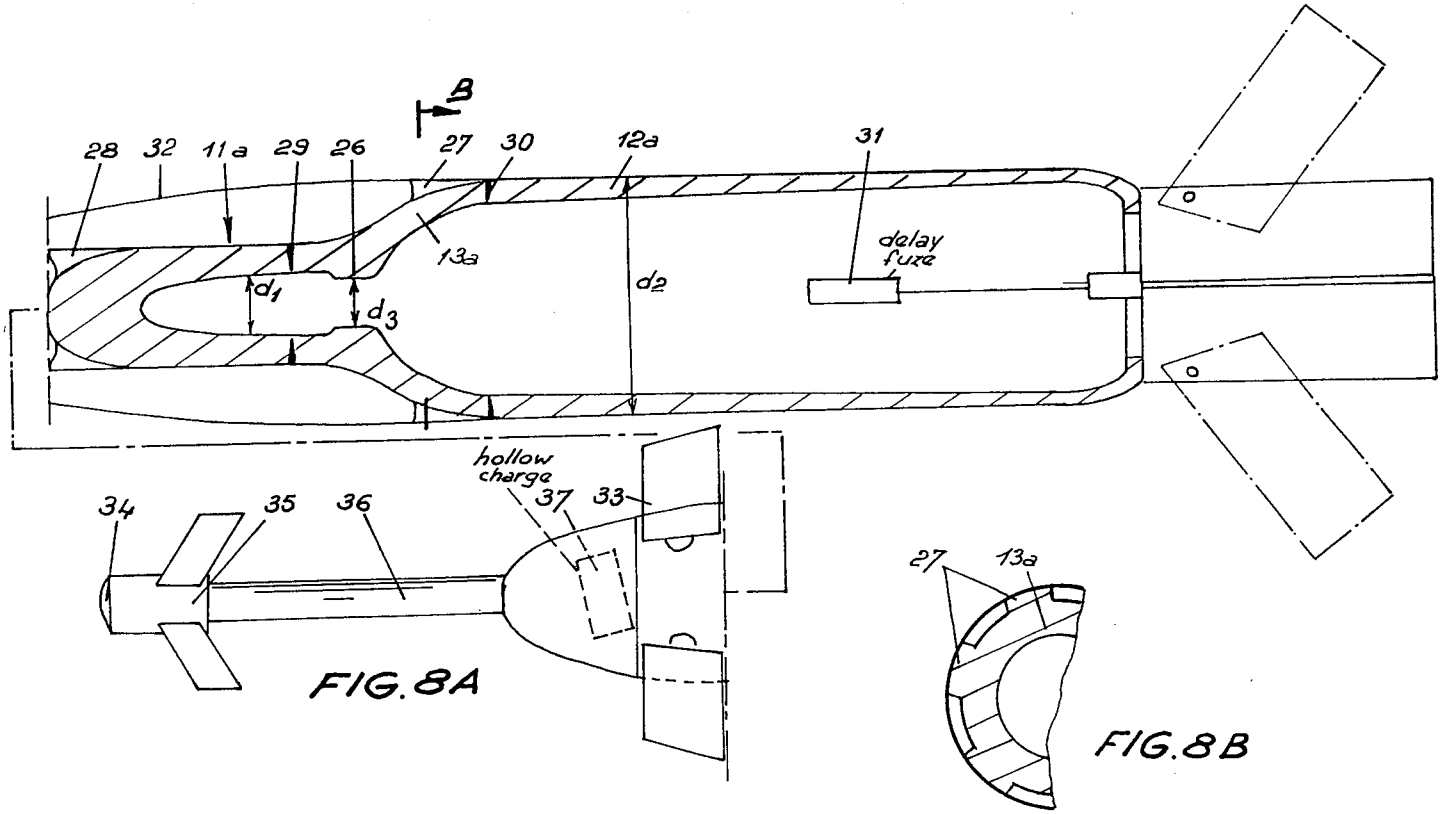

The variation shown in FIGS. 8A and 8B (the latter being a partial section along line B of FIG. 8A) also comprises two belts 26 and 27. But belt 27 is reduced to a series of external teeth (FIG. 8B) of extra thickness whose role is also to reduce the risk of ricochets: should the bomb arrive at an oblique incidence, there is contact by one of the teeth 28 provided at the front and separated by passages for the debris, avoiding jamming. If engagement by this tooth 28 is insufficient and if the bomb slips, engagement by one of teeth 27 tends to cause the bomb to swing to a direction promoting penetration thereof.

The front part 11*a*, of diameter $d_1$ substantially half of the maximum diameter $d_2$ of the rear part, is connected to this latter by a curved zone 13*a*, decreasing in thickness from the internal belt 26. This decrease continues along the rear part, cylindrical from about half of the length of the bomb.

The bomb which has just been described, fitted with a delay ignition fuse 31, will in general be equipped withh accessories whose nature depends on the mission. In FIG. 8A, the bomb is equipped so as to home on to a target illuminated by a designation laser. The front portion includes, within the fairing 32, the steering mechanism comprising servo motors for steering rudders 33. The mechanism receives input signals from a detector 34 carried by a swivel joint fitted with vanes 35 for compensating the inclination of the bomb with respect to its path. This swivel joint is carried by a pole 36 extending the fairing 32. An instant firing hollow or flat charge 37 may be placed in the nose of the bomb for splintering the target, to form a fore-hole therein to facilitate engagement of the bomb on impact and to destroy possibly existing front projections. So that the dart of charge 37 keeps all its penetration force, the charge is advantageously placed obliquely. Thus, the dart does not have to pass through the pole. An angle of 110° will be generally sufficient.

Finally, the bomb is provided at the rear with a conventional tail unit which can be of the type opened for stabilization purposes, retracted into an extension of the bomb during transport, coming into the opened out position as shown with dash-dot lines after being dropped.

In the variation shown in FIG. 9, there is again a pole 24 which is added to the front part 11*b*. Furthermore, this front part 11*b* carries hollow annular charges 25 for increasing the penetration and destruction power. The pole may be terminated by an added piece forming a cutting tool. This piece may more especially be formed from an ablative material, for example from ceramic, which disappears gradually as the attack progresses.

Figure 10:
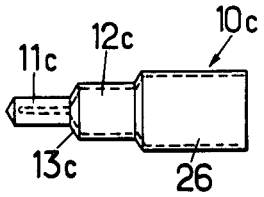

Finally, as shown in FIG. 10, bomb 10*c* may comprise not two parts but three, having successive stepped diameters 11*c*, 12*c* and 26, or even more, although the additional complication is not justified by an appreciable advantage. An additional charge (hollow or flat charge for example) may further be provided at the front to create a fore-hole and/or destroy a protection in front of the objective. This charge will be instant firing.

The shell of the bomb may be formed from the same material for all parts, for example from steel or a light alloy. But, for the rear part which does not have to withstand directly the impact force and does not have to perforate the concrete, a material of lower mechanical resistance than for the front part may be used. At the rear, for example, a light alloy or even a composite material with a carbon, glass or boron fiber base may be used, for example possibly coiled.

By way of example, a bomb of the kind shown in FIGS. 8A and 8B has been constructed having a steel shell, a total mass of about 1000 kg, reaching 150 m/s to destroy objectives such as dams, or bridge piers. With a total length of about 1900 mm, the front part may have a length of about 500 mm and a diameter $d_1$ half that of the rear. The thickness of the shell may decrease from 50 mm at the beginning of the connecting zone to 40 mm at the end of this zone and to 25 mm at the end of the rear part, which presents a c/m of about 0.9. The inner diameter $d_3$ of the belt 26 may be approximately equal to $d_1/2$.

The construction which has just been defined may also be adopted for constructing retarded-accelerated bombs for forming craters in concrete runways. In this case, a much smaller mass may be used of the order of 60 kg. Because of the increased penetration power, due to the reduced diameter of the front part, results are then obtained equivalent to those which require a much larger mass in the case of a conventional accelerated bomb. Moreover, not only is there a saving as regards the mass of the bomb properly speaking, but also as regards its propulsion system and the bomb may be droppedd at lower altitude, which is a safety factor for the carrier plane faced with anti-aircraft defence.

I claim:

1. A penetration bomb comprising a resistant body having a front part of smaller diameter and thicker wall and a rear part of greater diameter and thinner wall, connected by an intermediate portion arranged for transmitting engagement forces from said rear part to said front part on impact, and an explosive charge in both said parts, wherein the explosive filling coefficient of the front part is much lower than that of the rear part.

2. A bomb according to claim 1, wherein said front part and said rear part have diameters in a ratio of from 0.2 to 0.8.

3. A bomb according to claim 2, wherein said ratio is about 0.5.

4. A bomb according to claim 1, wherein said intermediate zone flares out rearwardly with an opening angle of from 60° to 120°.

5. A bomb according to claim 4, wherein said body has reinforcing belts at the junctions between said intermediate zone and said front and rear parts.

6. A bomb according to claim 1, wherein said front part is of a material selected from steel and light alloys and said rear part is of a material selected from steel, light alloys and composite materials.

7. A bomb according to claim 1, wherein said front part is provided with a forwardly protruding penetration tool.

8. A penetration bomb comprising a body having a front part, an intermediate part and a rear part, and an explosive charge contained in said body, said rear part having an explosive filling coefficient of at least 0.75, said front part having a diameter of from 0.2 to 0.8 time the diameter of the rear part, a thick resistant wall and an explosive filling coefficient of from 0.1 to 0.25 and said intermediate part being arranged for transferring penetration forces from said rear part to said front part on impact.

9. A bomb according to claim 8, wherein said front part carries a hollow charge provided with a fuse for instantaneous firing on impact.

10. A bomb according to claim 8, further comprising delayed firing fuse means.

11. A bomb according to claim 10, wherein said intermediate part has a generally frustoconical shape with an apex angle of from 60° to 120°.

12. A bomb according to claim 9, further comprising guiding means carried by a pole projecting forwardly from the front part, said hollow charge being directed obliquely with respect to said pole.

* * * * *